United States Patent [19]

Holl

[11] Patent Number: 4,611,548

[45] Date of Patent: Sep. 16, 1986

[54] TOP TRANSPORT FOR SEWING MACHINES

[75] Inventor: Helmar Holl, Karlsruhe-Durlach, Fed. Rep. of Germany

[73] Assignee: Dorina Nähmaschinen GmbH, Fed. Rep. of Germany

[21] Appl. No.: 782,283

[22] Filed: Sep. 30, 1985

[30] Foreign Application Priority Data

Sep. 28, 1984 [DE] Fed. Rep. of Germany ..... 3435633

[51] Int. Cl.[4] ..... D05B 27/06

[52] U.S. Cl. ..... 112/311; 112/320

[58] Field of Search ..... 112/311, 320, 312

[56] References Cited

U.S. PATENT DOCUMENTS

| | | | |
|---|---|---|---|
| 3,583,343 | 6/1971 | Meier | 112/320 |
| 3,583,344 | 6/1971 | Meier | 112/320 |
| 3,757,714 | 9/1973 | Gustmann et al. | 112/320 |
| 4,422,398 | 12/1983 | Dusch | 112/320 |
| 4,487,145 | 12/1984 | Vollmar | 112/320 |

FOREIGN PATENT DOCUMENTS 357477 2/1920 Fed. Rep. of Germany .

*Primary Examiner*—Henry S. Jaudon
*Assistant Examiner*—Andrew M. Falik
*Attorney, Agent, or Firm*—McGlew and Tuttle

[57] ABSTRACT

A top transport device on sewing machines includes a spring-loaded presser bar mounted for vertical movement, which is firmly connected with a presser foot, and with a two-armed top transport rocker in operative connection at its upper end via a connecting linkage with a feed drive and carrying a top transport foot, the rocker being mounted on a seating disposed on the presser bar. To improve the kinematic connection between top transport foot and presser foot, the seating is mounted freely displaceable on the presser bar and connected with a bearing piece fastened on the presser bar via an articulated link mechanism, at the articulated joint of which a lifting drive engages. A transitional phase of the pressure shift between presser foot and top transport foot when the latter sets down on the work and when it lifts off results by a connection of the top transport rocker with the seating via a limitedly swingable link.

6 Claims, 4 Drawing Figures

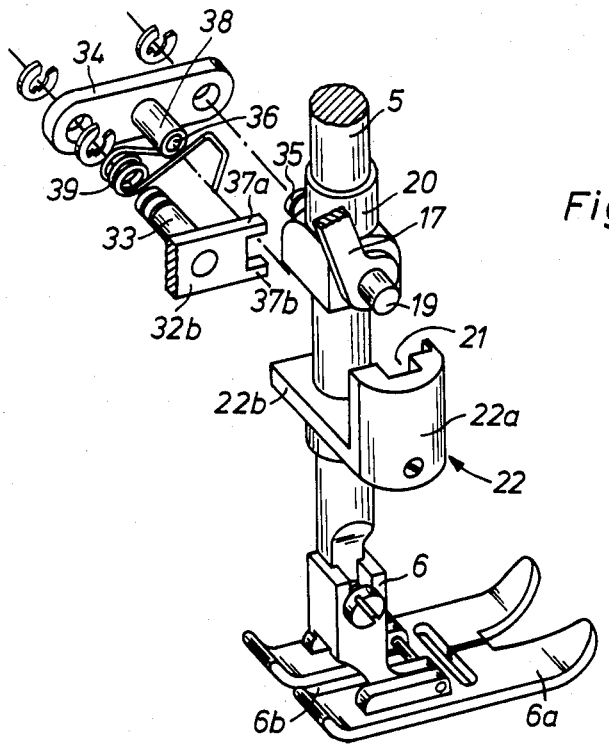
Fig. 4
Fig. 3
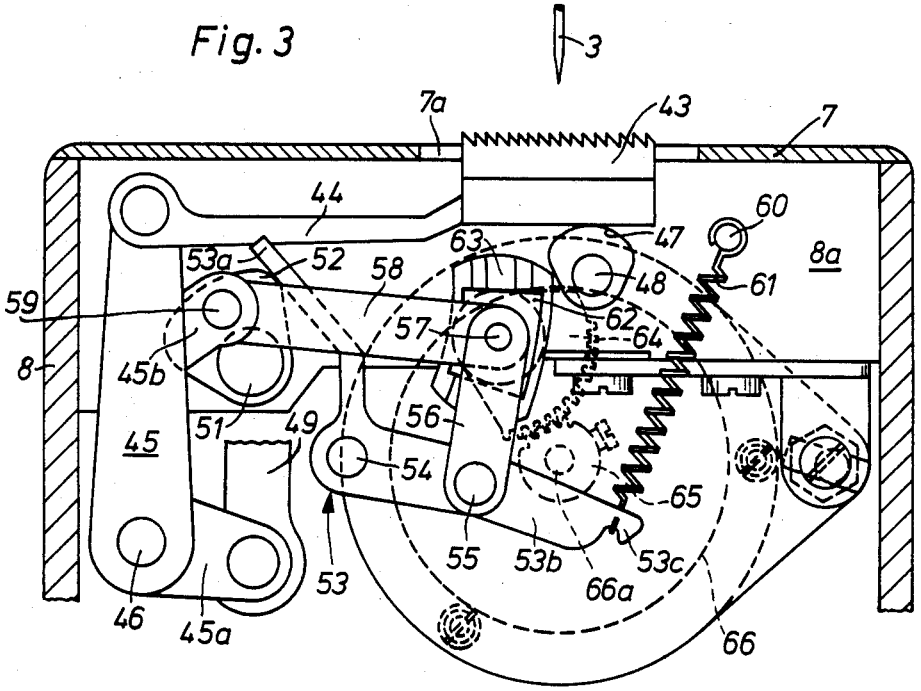

TOP TRANSPORT FOR SEWING MACHINES

FIELD AND BACKGROUND OF THE INVENTION

This invention relates in general to sewing machines and in particular to a new useful top transport device on sewing machines having a spring loaded presser bar mounted for vertical movement firmly connected with a presser foot.

In a known sewing machine of this kind (German Pat. No. 357,477) the seating for the top transport rocker is firmly connected with the presser bar and the top transport foot is fastened to the top transport rocker far behind the stitch formation point. As a result, the lifting and shifting movements influence each other differently depending on the adjusted stitch length.

SUMMARY OF THE INVENTION

The invention provides a simple and kinematically favorable lifting drive for a top transport device with a connection between the presser bar and the presser foot.

With the invention, there results a space-saving arrangement of the top transport rocker, of its seating and of its lifting drive, with the feature that the spring pressure acting on the top transport device extends essentially in the region of the axis of the presser bar and lateral forces are substantially avoided.

According to one embodiment of the invention, a transitional phase of the pressure displacement between the presser foot and the top transport foot is brought about when the top transport foot sets down on the work and when it lifts off. By the lift-off movement of the presser foot in the main shifting phase, unnecessary deceleration of the work is avoided.

In a top transport drive known through U.S. Pat. No. 3,583,344, for a household sewing machine, the presser foot is connected with the presser bar through a limitedly displaceable non-rotational sliding arrangement, in order to avoid a displacement of the spring pressure acting on the presser bar to the top transport foot. This arrangement, however, has the disadvantage that due to the necessary play in the sliding arrangement very undesirable conditions result at the stitch formation point when presser feet are used for the movement of cloth in particular when the feet project. This disadvantage is further intensified by the fact that the sliding arrangement cannot be arranged far enough away from the axis of the presser bar, because of the little space that is available. In addition, through the attached presser foot and corresponding cloth guiding devices attached thereto, the sliding arrangement is subjected to very high loads and hence to severe wear.

According to another embodiment of the invention a stable suspension of the top transport rocker on the presser bar is obtained, while the transverse forces occurring during feed are substantially absorbed.

Accordingly it is an object of the invention to provide a top transport feed for a sewing machine which has a spring biased presser bar with a presser foot secured thereto which includes a two armed top transport rocker in operative connection with a feed drive and carrying a transport foot in an arrangement in which the rocker is mounted on a seating disposed on the presser bar.

A further object of the invention is to provide a sewing machine feeding device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is a section through the bottom arm of the sewing machine with the feed drive for the lower feeder; and FIG. 4 is a perspective view of the lower portion of the presser bar.

DESCRIPTION OF THE PREFERRED EMBODIMENT

Figure 1:
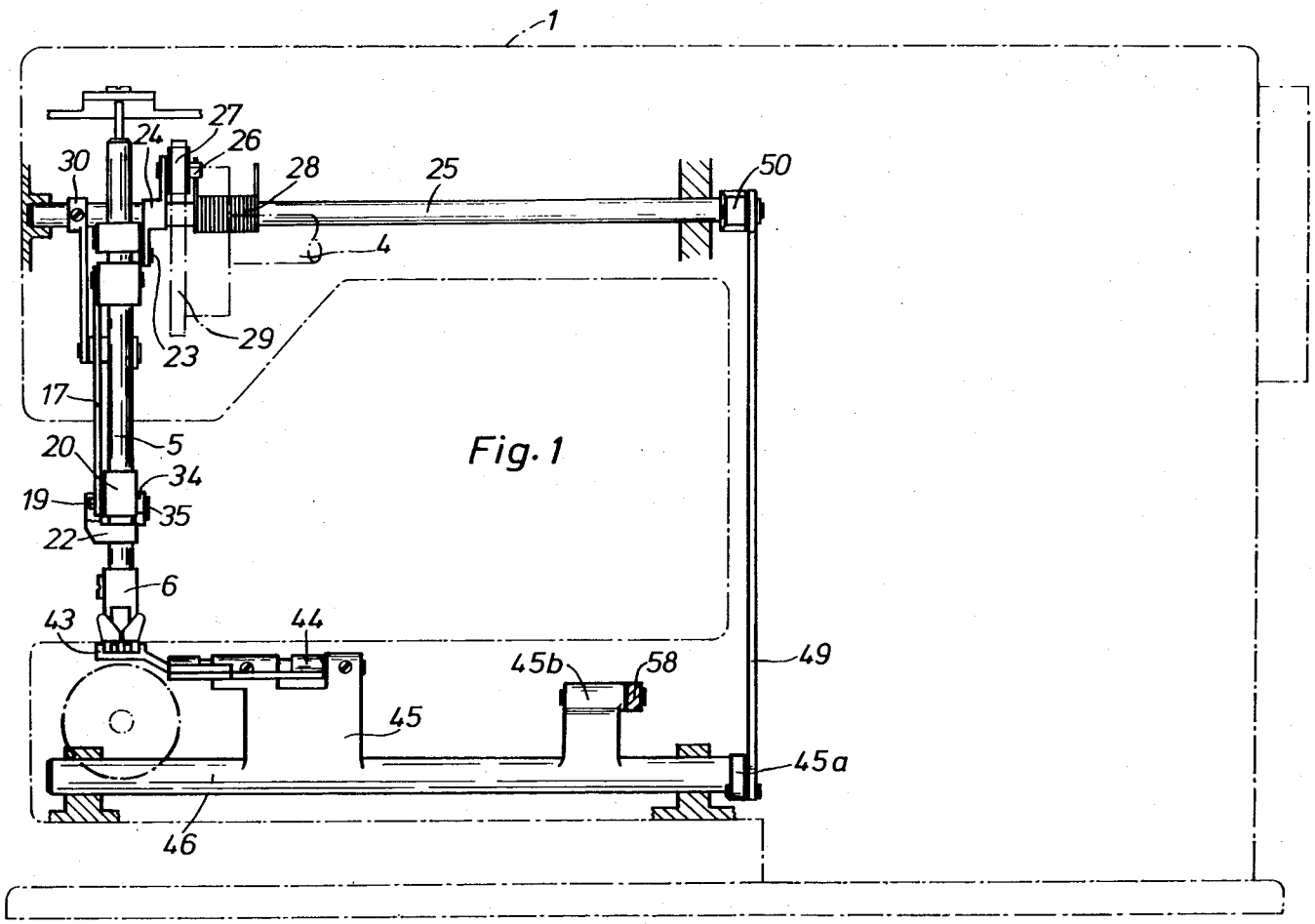
FIG. 1 is a front view of the transport device in a sewing machine constructed in accordance with the invention.

Referring to the drawings in particular, the invention embodied therein comprises a top transport device on sewing machines which have a spring loaded presser bar 5 mounted for vertical movement and firmly connected with a presser foot 6. The transport device includes a two-armed top transport rocker generally designated 32 which is in operative connection with a feed drive carrying a top transport foot 40. The top transport foot has a rocker arm **32*b* mounted on a seating 20 of the feeding area of the presser bar 5. Seating 20 is mounted freely displaceable on the presser bar 5 and is connected with a bearing piece 14 secured on the presser bar through an articulated link mechanism 16 which has a joint 18 and is connected to a link drive designated by the numerals 23 through 29**.

Figure 2:
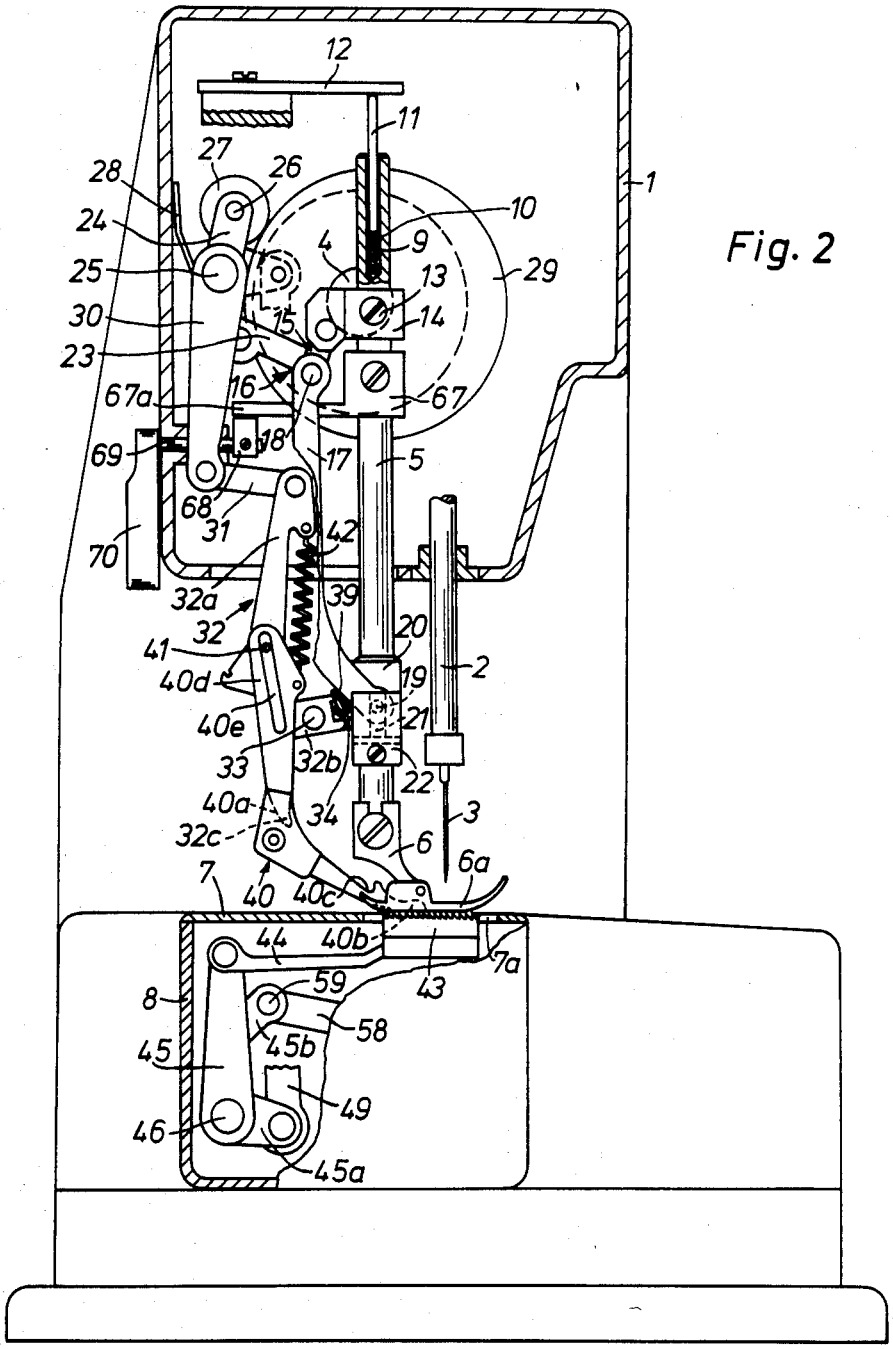
FIG. 2 is a section through the head and bottom arm of the sewing machine with feed tools in an operating position.

As FIG. 2 shows, in the housing 1 of the sewing machine a needle bar 2 with a needle 3 is mounted and is driven by a main shaft 4 of the sewing machine.

A presser bar 5 likewise mounted in housing 1 carries a presser foot 6, with a sole **6*a* which is supported on a stitch plate 7. The plate 7 covers a bottom arm 8 of housing 1. In its upper part the presser bar 5 has an axial bore 9 in which are guided a compression spring 10 and a pin 11. The pin 11 abutts a strike plate 12 fastened in housing 1**.

By a screw 13 a bearing piece 14 is fastened on the presser bar 5 and has articulated to it a link 15 of an articulated joint or link mechanism 16 which consists of the links 15 and 17 which are joined together by the joint or pin 18. Link 17 is connected with a laterally protruding gudgeon or pin 19 (see also FIG. 4) of the seating 20 displaceable on the presser bar 5. Gudgeon 19 extends beyond the point of articulation with link 17 into a vertically extending guideway 21 of a guide **22*a* of a guide piece 22 parallel to the presser bar 5. Guide piece 22 is fastened on the presser bar 5 through a shoulder in the lower portion, spaced from the movement path of the seating 20**.

The articulated joint 18 is connected through a link 23 with a rocker 24. The latter is freely rotatably on a swinging shaft 25 mounted in housing 1 and carries gudgeon 26 on which a roller 27 is mounted. A coil spring 28 (see also FIG. 1) on the swinging shaft 25 has one end bracing against housing 1 and the other end against gudgeon 26 and presses the roller 27 against an eccentric disc 29 firmly connected with the main shaft 4.

Fastened on shaft 25 is a crank arm 30 which is connected through a link 31 with the upper end 32*a* of a top transport rocker 32. In its central portion the latter has an arm 32*b* (FIG. 4) which carries a pivot pin 33. Pivot pin 33 is connected via a link 34 with a pin or gudgeon 35 which is fastened on the seating 20 diametrically to pin 19. Fastened in link 34 is a pin 36 which protrudes between two stops 37*a* and 37*b* formed on arm 32*b*. Pin 36 is spring supported relative to the stops 37*a* and 37*b* by a plastic tube 38. A spiral spring 39 mounted on the pivot pin 33 braces itself against the pin 36 and against the arm 32*b*, and in so doing pushes the pin 36 against the upper stop 37*a*.

The downwardly extending portion of the top transport rocker 32 (FIG. 2) has a wedge-shaped free end 32*c*, which is insertable into a corresponding wedge-shaped cutout 40*a* of a top transport foot 40 in order to hold the foot in its operative position. The top transport foot 40 is provided with a tooth piece 40*b* which jointly with the sole 6*a* articulated at the presser foot 6 (see also FIG. 4) engages at the work from above. To this end sole 6*a* is provided with a slot 6*b* through which the tooth piece 40*b* can pass.

Above the tooth piece 40*b* a cutout 40*c* is provided, into which the end 32*c* of the top transport rocker 32 is insertable. To this end the top transport foot 40 has upwardly extending arms 40*d*, comprising a guide slot 40*e*. The sides of said arms slidingly engage a projecting pin or gudgeon 41 supported on the rocker 32.

A spring 42, hooked by one end to the top transport foot 40 and by the other end to the top transport rocker 32 pulls foot 40 upward, to ensure engagement between cutout 40*a* and the end 32*c*.

Cooperating with the top transport foot 40 and the presser foot 6 through slots 7*a* of stitch plate 7 (FIG. 3) is a lower cloth feed 43 which is fastened on a support 44. Support 44 is articulated to a swinging lever 45 which is mounted on an axle 46 mounted in the bottom arm 8. Engaging the support 44 from below is a lifting cam 47 which is fastened on a shaft 48 mounted in the bottom arm 1 and connected with the drive of the sewing machine.

The swinging lever 45 has an arm 45*a* which is connected through a link 49 (FIG. 1) with a crank arm 50 fastened on the swinging shaft 25.

In a housing wall 8*a* extending crosswise to the bottom arm 8 (FIG. 3) a shaft 51 is mounted, on which an eccentric 52 is fastened. Shaft 51 is connected to the drive of the sewing machine in a known manner (not shown). Engaging the eccentric 52 is an arm 53*a* of a double lever 53 which is fastened on a gudgeon 54 mounted in the housing wall 8*a*. The other arm 53*b* of the double lever 53 is connected by a pin 55 with a link 56. The link 56 is connected by a pin 57 with a connecting rod 58 which is mounted by a bolt 59 with its other end at an eye 45*b* of the swing lever 45.

A spring 61 hooked at an eyelet 53*c* at the double lever 53 and at a bolt 60 fastened in the housing wall 8*a* pulls arm 53*a* of double lever 53 against the eccentric 52.

On gudgeon 57 a sliding block 62 is rotatably mounted which cooperates in known manner with a slideway 63. The latter is fastened on the end of a regulating shaft (not shown) with which a tooth segment 64 is firmly connected. With the latter a pinion 65 is in engagement, which is firmly connected with a drive shaft 66*a* of a step motor 66 fastened in the bottom arm 8.

On the presser bar (FIG. 2) a holder 67 is fastened which has a rearwardly extending arm 67*a*. This arm 67*a* engages from below a cam piece 68 fastened on a shaft 69 which extends through the housing and carries at its external end a hand lever 70.

The device operates as follows:

When the sewing machine is driven, shaft 51 (FIG. 3) rotates, which causes the eccentric 52 to push the slide-block 62 back and forth on the sliding surfaces of slideway 63 via the double lever 53 and the link 56 connected therewith. According to the angle setting of the slideway 63, which is given it by the step motor 66 via the regulating shaft (not shown) the slide-block 62 swivels the swinging lever 45 via the push rod 58 and thus imparts to the feeder 43 forward movements whose size and direction depend on the angular position of the slideway 63.

Synchronously with the rotation of shaft 51, the lifting cam 47 is driven through shaft 48 and imparts lifting movements to the feeder 43.

Simultaneously with the drive of feeder 43, the swinging lever 45 imparts swinging movements to the swinging shaft 25 via arm 45*a* (FIG. 1), link 49 and crank arm 50; these swinging movements are transmitted to the top transport rocker 32 via crank arm 30 (FIG. 2) and link 31.

The top transport rocker 32 is then pivoted about the gudgeon 19 fastened on the seating 20 (see also FIG. 4), as the spiral spring 39 tensions link 34 with arm 32*b* so strongly that this connection may be regarded to be rigid. The top transport foot 40 executes feed movements. Due to said connection and their similar transmission ratios both displacement paths of the lower feeder 43 and the top transport foot 40 with the swinging lever 45 are of equal length.

The lifting movement of the top transport foot 40 occurs through the eccentric disc 29 (FIG. 2) via roller 27, which brings about the movement of rocker 24 and of link 23. The link 23 swings the articulated joint 18 out, whereby shifting movements on the presser bar 5 are imparted to the seating 20 via link 17. The link 34 and hence the arm 32*b* of the top transport rocker 32 (FIG. 2) is then entrained via gudgeon 35 (FIG. 4), whereby rocker 32 and the top transport foot 40 connected therewith execute lift movements.

As the articulated joint mechanism 16 flexes out, that is, when the seating 20 is lifted, the top transport foot 40 is raised via the link 34 and the top transport rocker 32. The arrangement receives support from the presser foot 6, which rests on the work by the pressure of the compression spring 10. During the following expansion of the joint mechanism 16, the seating 20 is displaced downwardly on the presser bar 5 by the link 17. This causes gudgeon 35 with link 34 and the top transport rocker 32 connected therewith to move downward. The top transport foot 40 places itself with its tooth piece 40*b* on the work. Further lowering of the seating 20 can then not lower the top transport foot 40 any further. Thereby the pivot pin 33 serving as pivot for the top transport rocker 32 remains at its level and the pin 36 (FIG. 4) or the plastic tube 38 disposed thereon detaches counter to the influence of the spiral spring 39 from its upper stop 37*a* and moves to the lower stop 37*b*. The tooth piece 40*b* now rests on the work under the pressure of the spiral spring 39.

At the same time the teeth of the feeder 43 (FIG. 2) now emerges over the surface of the stitch plate 7, whereby the top transport foot 40 and the presser foot 6 are raised jointly. Due to the structural location of the pivot of link 23 at the rocker 24, the joint mechanism 16 is further expanded by this lifting, and pin 36 places itself against the lower stop 37*b*. Here the plastic tube 38 serves as damping member. The abutment occurs sooner when the plies to be sewn are thicker, as the entire system then occupies a higher position.

As soon as pin 36 engages the lower stop 37*b*, the seating 20 cannot drop any further, and the bearing piece 14 is pushed upward with further expansion of the joint mechanism 16, so that the presser foot 6 is easily lifted off the work via the presser bar 5 during the middle portion of the displacement phase by feeder 43 and top transport foot 40. The force of compression spring 11 is then transmitted via joint mechanism 16, seating 20, link 34 and top transport rocker 32 to the top transport foot 40.

Raising of the presser foot 6 and of the top transport foot 40 for inserting or removing the work is done by turning the hand lever 70. Cam 68 will then push the holder 67 together with the presser bar 5 upward via arm 67*a*. In the same degree the bearing piece 14 takes along via the joint mechanism 16, the seating 20 and the link 34 and hence the top transport rocker 32 connected with the top transport foot 40.

To exclude the top transport foot 40, the latter is lifted off the end 32*c* of the top transport rocker 32 by hand counter to the action of spring 42 in the raised state of the presser arrangement and is pivoted rearwardly. The guide slots 40*e* then shift relative to the gudgeon 41, and the end 32*c* snaps into the recess 40*c*.

While a specific embodiment of the invention has been shown and described in detail to illustrate the application of the principles of the invention, it will be understood that the invention may be embodied otherwise without departing from such principles.

What is claimed is:

1. A top transport feed for a sewing machine having a spring-loaded presser bar with a presser foot which may be moved into and out of association with a material being fed, and which is driven by a feed drive located over a base of the sewing machine housing, comprising a feeding means displaceably mounted on the presser bar, a top transport foot alongside the presser bar, a two-armed top transport rocker driven by the feed drive and carrying said top transport foot mounted on said feeding means, first and second pins carried on respective sides of said feeding means, a bearing piece secured on said presser bar, an articulated link mechanism connected between said bearing piece and said feeding means and having a joint and including a first link pivoted on said first pin and an end connected with said bearing piece and a second link connected to said second pin and said top transport rocker, a lifting drive connected to said joint, a guide track connected to said presser bar, and at least one of said first and second pins protruding into said guide track.

2. A top transport device according to claim 1 wherein said transport rocker includes a link having a pin which protrudes, and including stop means on each side of said pin fastened to said second link, and a spring pressing said pin in one of said stops.

3. A top transport device according to claim 2, wherein said pin has a damping covering.

4. A top transport device according to claim 1, wherein said first link has an additional pin secured to it and diametricaly opposite to said first pin, said joint mechanism having a link articulated to said additional gudgeon.

5. A top transport device according to claim 1 wherein said feed drive is connected to the lifting drive so that said feed drive has substantially an equal displacement with said top transport foot.

6. A top transport feed for a sewing machine having a base and a spring loaded presser bar with a presser foot which may be moved into and out of association with material being fed by a feed drive over the base of the sewing machine, comprising a seating displaceably mounted on the presser bar, a top transport foot alongside the presser bar, a two armed top transport rocker driven by the feed drive and carrying said top transport foot, said two armed top transport rocker being connected to said seating for movement with movement of said seating, a bearing piece secured on said presser bar, an articulated link mechanism connected between said bearing piece and said seating and having a joint, and a lifting drive connected to said joint.

* * * * *